US005323587A

United States Patent [19]

Amaranti

[11] Patent Number: 5,323,587

[45] Date of Patent: Jun. 28, 1994

[54] DEVICE FOR FORMING A STACK OF BLISTER PACKS AND THEN INSERTING THE STACK, TOGETHER WITH AN INSTRUCTION LEAFLET, INTO A CARTON

[76] Inventor: Alessandro Amaranti, Castel S. Pietro, Terme (Bologna), Italy

[21] Appl. No.: 707,573

[22] Filed: May 30, 1991

[30] Foreign Application Priority Data

Jun. 7, 1990 [IT] Italy ..... 3543 A/90

[51] Int. Cl.[5] ..... B65B 35/52; B65B 35/40; B65B 5/06; B65B 49/04

[52] U.S. Cl. ..... 53/155; 53/157; 53/541; 53/247; 53/258

[58] Field of Search ..... 414/795.3, 790.3; 53/540, 541, 247, 238, 258, 559, 447, 474, 155, 157

[56] References Cited

U.S. PATENT DOCUMENTS

| | | | |
|---|---|---|---|
| 3,107,013 | 10/1963 | Euwe | 414/790.3 |
| 3,564,812 | 2/1971 | Mueller et al. | 53/471 X |
| 3,576,255 | 4/1971 | Warren | 414/795.3 X |
| 3,895,574 | 7/1975 | Nyborg | 414/795.3 X |
| 4,201,027 | 5/1980 | Ilsemann | 53/238 X |
| 4,517,791 | 5/1985 | Focke | 53/541 X |
| 4,750,317 | 6/1988 | Vrana | 53/541 |
| 4,955,783 | 9/1990 | Grazia | 414/795.3 X |

FOREIGN PATENT DOCUMENTS

| | | |
|---|---|---|
| 2340860 | 9/1977 | France . |
| 2608997 | 7/1988 | France . |
| 2051014 | 1/1981 | United Kingdom . |

*Primary Examiner*—Horace M. Culver

[57] ABSTRACT

A device comprises a conveyor for moving blister packs to a stack forming station where a lift inserts the blister packs 2 coming off the conveyor into a magazine to form a stack of blister packs. Then a pusher moves the stack out of the magazine and into a drawer that receives the stack and that is provided with an outfeed opening which externally has a shape of a beak. The drawer is movable so that this opening comes into contact with an instruction leaflet positioned aside of the drawer and in front of an opening of a carton, while two strikers act in conjunction with the drawer for folding the instruction leaflet. Finally an ejector insert the stack together with the instruction leaflet into the carton.

11 Claims, 5 Drawing Sheets

DEVICE FOR FORMING A STACK OF BLISTER PACKS AND THEN INSERTING THE STACK, TOGETHER WITH AN INSTRUCTION LEAFLET, INTO A CARTON

BACKGROUND OF THE INVENTION

This invention concerns the technical sector dealing with packing into cartons various products which are supplied in a type of packaging generally known as blister packs, such as pharmaceutical tablets or capsules.

In particular the invention concerns a device which forms a stack of blister packs and then inserts the stack, together with an instruction leaflet, into a carton.

DESCRIPTION OF THE PRIOR ART

Automatic devices of different types are known which insert a single blister pack or a stack of blister packs into a corresponding carton.

In one such known device the blister packs are stacked, from below upwards, within a vertical magazine, from which they are removed in batches by means of a pusher pushing crossways with respect to the same magazine. The blister packs are then inserted into a movable drawer, from which they are thereafter removed, again by pushing organs, for insertion into a carton.

At present devices of this type have many drawbacks, since for example the pusher may move the wrong number of blister packs because the latter may not always be perfectly flat.

Such devices furthermore often do not enable appropriate solutions to be found to the problem of inserting the instruction leaflet, which usually accompanies the blister pack, into the carton together with the blister pack. In fact usually the leaflet is intercepted by the stack of blister packs being pushed out from the drawer and is forced into the carton by the stack.

If the leaflet happens to be relatively thick, the stack of blister packs may become misaligned; or else the stack may not succeed in folding the instruction leaflet, in particular when only one single blister pack is being put into each carton.

SUMMARY OF THE INVENTION

The object of this invention is to provide a device which quickly and accurately forms a stack of blister packs and then inserts this stack, together with an instruction leaflet, into a carton.

A further object of this invention is to provide a device which is made according to simple technical principles, and is functional, reliable and versatile.

These objects are achieved by means of a device for forming a stack of blister packs and then inserting this stack, together with an instruction leaflet, into a corresponding carton.

The device comprises a conveyor that convey the blister packs to a stack-forming station where they are supported by a pair of guides, and where a lift operates to insert the blister pack supported by the guides, moving it upwards, into a magazine.

Then a pusher moves the stack of blister packs formed in the said magazine into a drawer that receives the stack of blister packs and is provided externally with a beak-shaped outfeed opening.

The drawer is made to move in order for the beak-shaped opening to be pushed into contact with an instruction leaflet positioned in front of a corresponding opening in a carton for the blister packs while two strikers, in conjunction with the action of the drawer, fold the instruction leaflet.

Finally an ejector is actuated synchronously with the drawer, to insert the stack of blister packs together with the instruction leaflet into the carton.

BRIEF DESCRIPTION OF THE DRAWINGS

The advantages and the characteristics of this invention which are not apparent from the above description are explained in greater detail in the description which follows, with particular reference to the accompanying drawings, in which.

DESCRIPTION OF THE PREFERRED EMBODIMENT

Figure 1:
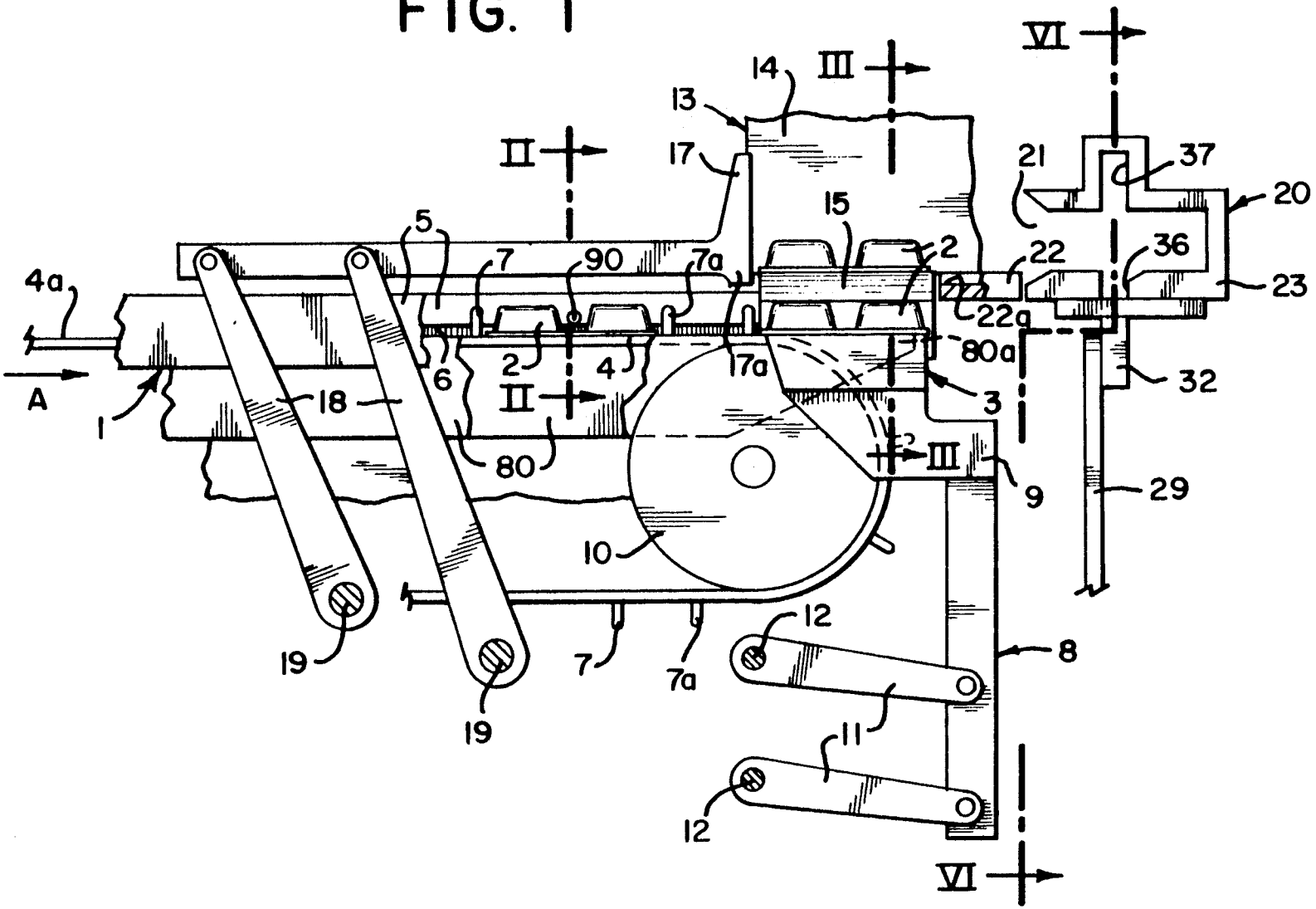
FIG. 1 shows a side view of the device for forming a stack of blister packs and then inserting it into a corresponding carton.

With reference to the above drawings, the device being the subject of this invention, includes a blister pack 2 conveyor 1, and a blister pack stack-forming station 3.

The conveyor 1 has a pair of belts 4 arranged side by side, which move with an intermittent motion in the direction indicated by the arrow A.

Between these belts and on the upper surface 4*a* there is a spacer 70 which prevents the two belts from overlapping.

Figure 2:
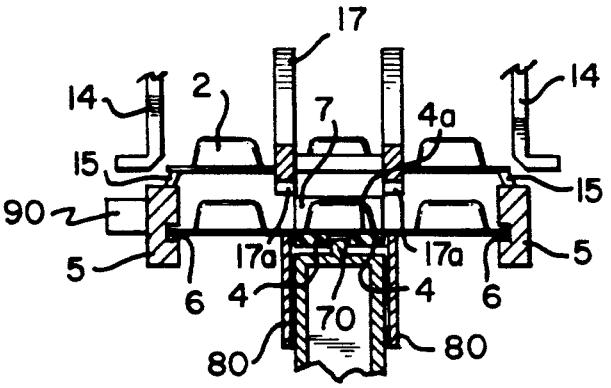
FIG. 2 shows a cross-section view at the line II—II in FIG. 1.
Figure 3:
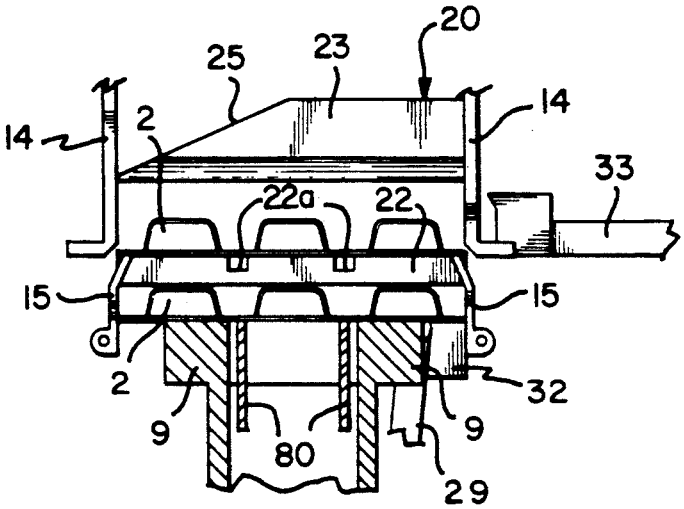
FIG. 3 shows a cross-section view at the line III—III in FIG. 1.
Figure 4:
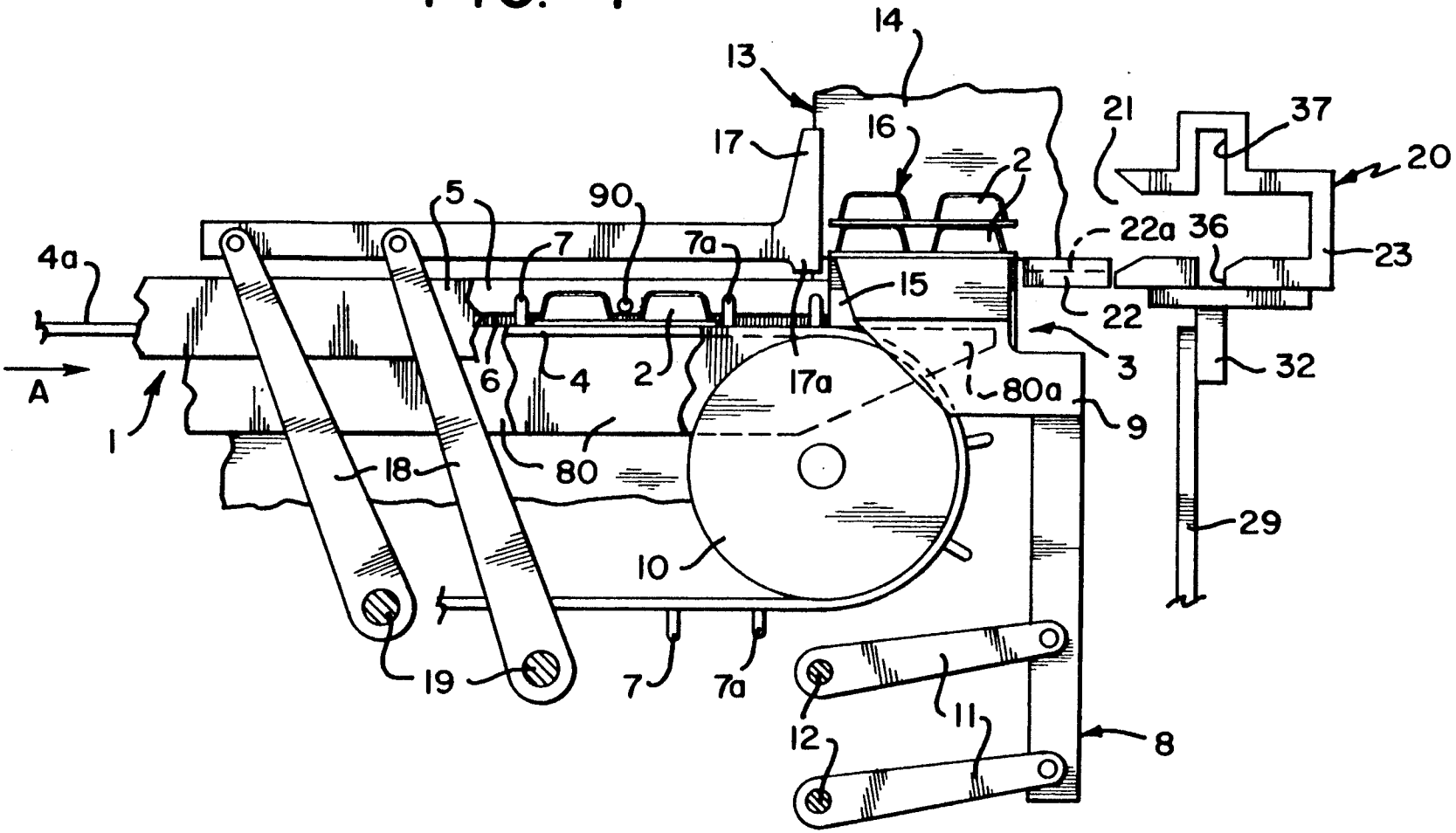
FIGS. 4 and 5 show side views, as in FIG. 1, of the device in question during different stages of operations.

At the side of each belt, at the level of the upper surface 4*a*, there are vertical guides 80 running longitudinally to the belts and which protrude slightly above the same (FIG. 2); these guides continue beyond the wheels 10 on which the belts rotate (FIG. 4).

Externally to the guides 80 there are sidepieces 5 which have a lengthways groove 6 which serves as a guide for the edges of the blister packs 2, the latter protruding with respect to the same belts 4.

The belts 4 are provided with crosspieces 7, within which the blister packs being conveyed are held.

The position occupied by the crosspieces 7 on the belts 4 is adjustable so as to enable blister packs of different sizes to be held; in particular it is envisaged that the crosspieces 7*a* are movable in relation one to the other (for example by means of relative movement of the belts 4) so as to vary the distance between the same crosspieces and match it to the blister size.

At the stack-forming station 3, there ia a lift, indicated in the drawings by 8. This lift 8 has a pair of blocks 9 situated externally with respect to the wheels 10, in the outfeed area of the conveyor 1.

The ends 80*a* of the guides 80 are situated between these blocks; the function of the guides 80 is to receive and support the blister packs arriving from the end part of the said upper surface 4*a*.

The blocks are actuated in a vertical direction by oscillating arms 11, which pivot on pins 12 so as to form a jointed quadrilateral.

The blocks 9 of the lift 8 rise the blister pack 2, supported by the ends 80*a* of the guides 80, in an upwards direction, inserting it into a magazine 13 of the stack-forming station 3.

The magazine 13 consists of a pair of sides 14, placed lengthwise to the sidepieces 5 of the conveyor 1; pivoting supports 15 designed to support the stack (here designated by 16) of blister packs are elastically fixed to the base of the magazine 13, so as to correspond with the edges of the lower surface of the blister packs 2.

Above the conveyor 1 there is a movable pushing organ 17 designed to move the stack 16 of blister packs formed in the magazine 13. The pusher 17 is actuated in a lengthwise direction with respect to the conveyor 1, by oscillating arms 18, which pivot on pins 19 so as to form a jointed quadrilateral.

In front of the magazine 13, there is a drawer 20 designed to receive the stack 16 of blister packs; the drawer 20 has a chamfered infeed opening 21, facing in the direction of the magazine 13. Between the magazine 13 and the drawer 20 there is a surface 22 where the stack 16 slides, having grooves 22*a* in which corresponding teeth 17*a* of the pusher 17 move freely.

Figure 6A:
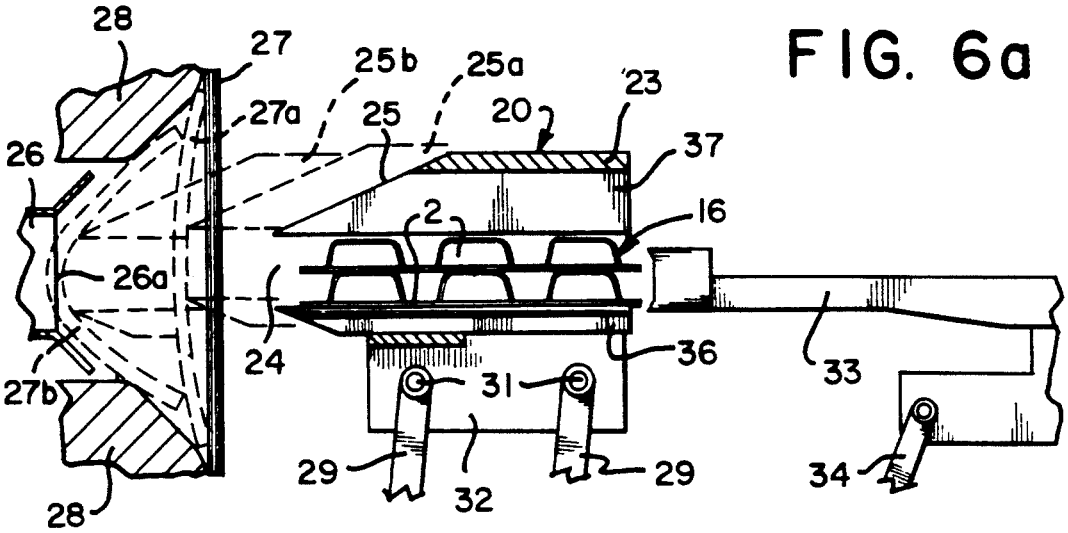
FIGS. 6*a* and 6*b* show cross-section views at the line VI—VI in FIG. 1, during successive stages of insertion of a stack of blister packs into the carton.

The drawer 20 constitutes a housing 23 open at the ends which are transverse to the direction of insertion of the stack 16. In particular, the housing 23 has an outfeed opening 24 for the stack 16, where the drawer 20 is shaped like a beak 25 (see FIGS. 6*a*, 6*b*).

The drawer 20 moves in a vertically transverse plane to the conveyor 1 so that the outfeed opening 24 docks with a corresponding opening 26*a* of a carton 26 for blister packs 2. At this stage, the beak 25 of the drawer 20 intercepts an instruction leaflet 27, which is to be inserted into the carton 26 together with the blister packs 2; the leaflet is located in front of the opening 26*a* of the carton 26, in contact with striker means 28 for folding, which act in conjunction with the same drawer 20.

The drawer 20 is actuated by an organ 29 with oscillating arms, which pivots on pins 30 so as to form a jointed quadrilateral; the arms 29 are attached by pins 31, to a plate 32 fixed to the lower part of the drawer 20.

There is an ejector 33 which acts in conjunction with the drawer 20 and which moves in the same vertical plane as the same drawer 20. The ejector is actuated, synchronously with the drawer 20, by oscillating arms 34, which pivot on pins 35 so as to form a jointed quadrilateral.

The ejector 33 enters into the housing 23 of the drawer 20, from the side opposite to the outfeed opening 24; to enable the ejector 33 to pass, the draw 20 has a slot 26 below and contains an upper channel 37.

Operation of the device described above is subordinated to the consent of organs 90 situated upstream of the magazine 13, which check that the blister pack is present.

This operation will now be illustrated from the moment when a blister pack 2 is placed at the stack-forming station 3.

The blister pack 2 being fed out by the conveyor 1 is pushed by the back crosspiece 7 against the ends 80*a* of the guides 80; the blocks 9 of the lift 8 at this stage are very nearly at the same level as the said upper surface of the conveyor belts 4 (FIG. 1).

Actuation of the lift 8 raises the blister pack 2, which is inserted into the magazine 13 located above, pushing aside the pivoting supports 15 which hold up the stack. The blister pack 2 then rests on the pivoting supports 15, forcing upwards any blister packs already present in the magazine 13 (FIG. 4). In this way a stack 16 of blister packs is formed, from the bottom upwards.

Figure 5:
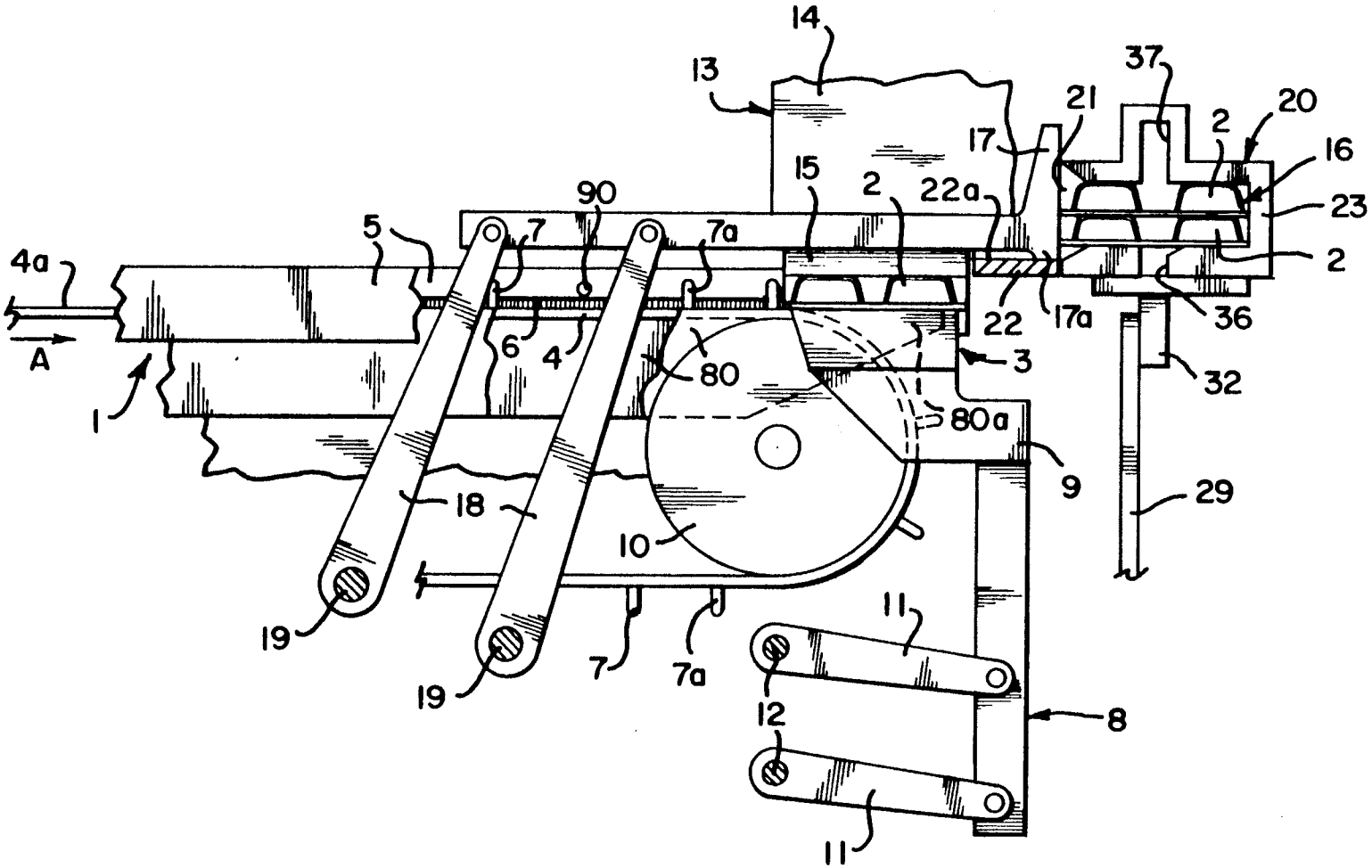

After the stack 16 has been formed with the desired number of blister packs, the pusher 17 is actuated and pushes the said stack 16 into the drawer 20 (FIG. 5).

Then the oscillating arms 29 are actuated pushing the drawer 20 in the direction of the carton 26 to be filled. As it draws nearer to the carton 26, the beak 25 of the drawer 20 intercepts the instruction leaflet 27, folds it over the strikers 28 as is clearly visible in FIG. 6*a* where the dotted lines 25*a*, 25*b* indicate successive positions assumed by the beak 25 during folding of the leaflet 27; the lines 27*a* and 27*b* indicate the respective positions of the leaflet 27.

Figure 6B:
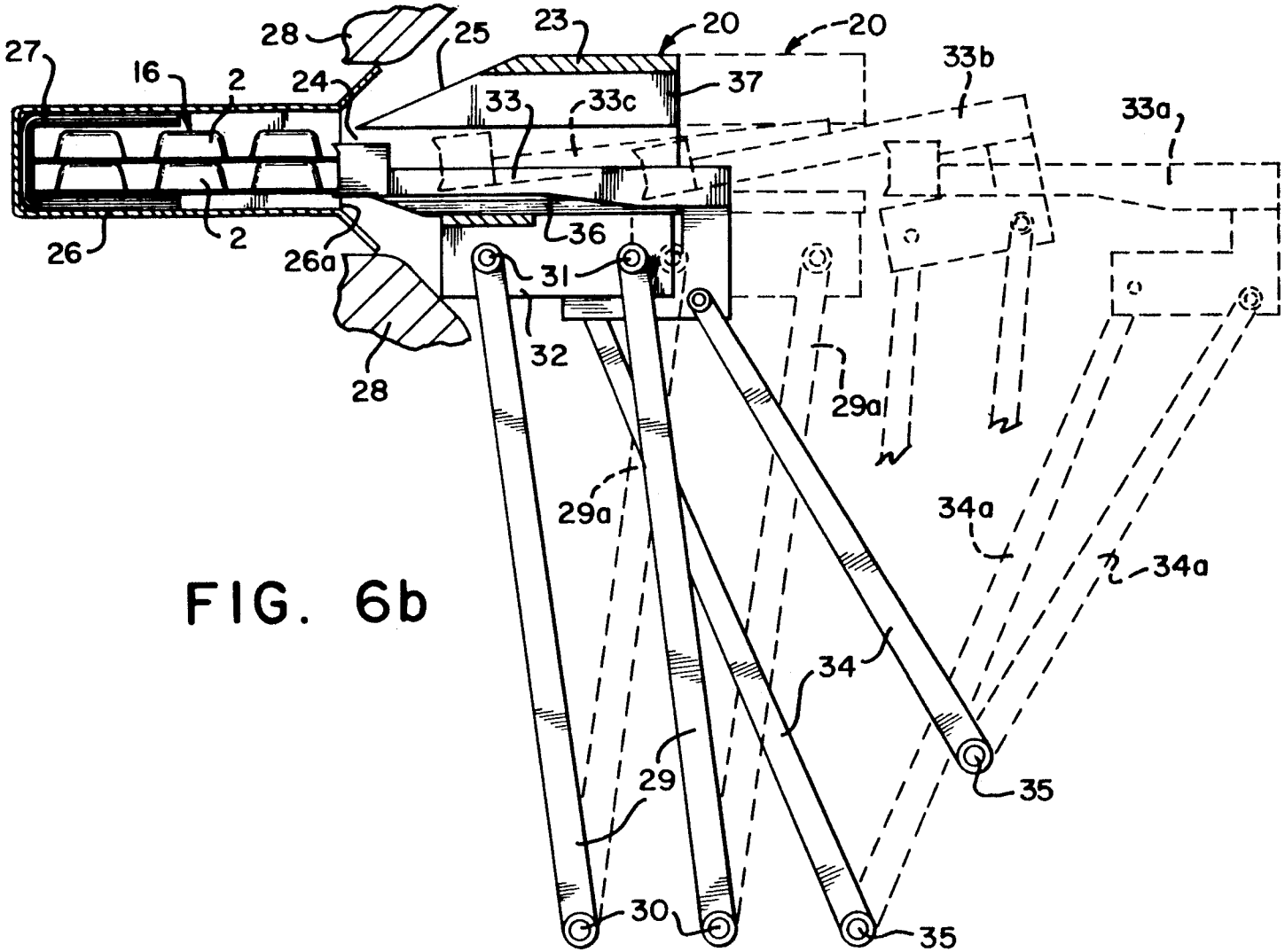

The ejector 33 is actuated synchronously with the drawer 20, following, during the first stage of its travel, the movement of the same drawer; when the drawer 20 stops, the ejector 33 continues its travel entering into the same drawer thus causing the stack 16 of blister packs 2 to be pushed out of the opening 24, as shown in FIG. 6*b* where the dotted lines 33*a*, 33*b* and 33*c* indicate successive positions assumed by the said ejector; the lines 29*a* and 34*a* indicate the initial positions of the oscillating arms 29, 34.

The stack 16 of blister packs 2 during entry into the carton 26 pushes the instruction leaflet 27, and completes folding inside the same carton 26.

In the case shown, the stack 16 inserted into the carton 26 consists of two blister packs 2; it must be noted however that one single blister pack 2 can be inserted into the carton 26.

The folding of the instruction leaflet 27 effected by the beak 25 of the drawer 20 guarantees in any case that the blister packs 2 are correctly inserted into the carton 26.

The invention, as described above is only an example, and can be subject to numerous modifications and variations, all of which enter within the terms of the invention. All the details of this invention can be substituted by their technical equivalents.

What is claimed is:

1. A device for forming a stack of blister packs and then inserting said stack, together with a leaflet into a corresponding carton, said device comprising:

a conveyor for conveying blister packs, to a stack forming station where each of said blister packs is supported by a pair of guides;

a lift that at said station moves a blister pack supported by said guides upward, inserting said blister pack into a magazine to form a stack of blister packs;

a pusher which moves said stack of blister packs formed in said magazine;

a drawer designed to receive said stack of blister packs and having an outfeed opening shaped like a beak, said drawer being movable to push with said beak-shaped opening on an instruction leaflet located aside of said drawer and in front of a corresponding opening of a carton for said blister packs;

striker means located between said leaflet and said carton for folding, in conjunction with said drawer, said instruction leaflet;

an ejector actuated synchronously with said drawer to push said stack out of said drawer and to insert said stack, together with said instruction leaflet, into said carton.

2. A device according to claim 1, wherein said drawer is provided with an infeed opening facing said magazine, said drawer forming a housing open at ends resulting transverse to a direction of insertion of said stack, with said outfeed opening for said stack being made at one of said ends.

3. A device according to claim 1, wherein said drawer moves on a plane vertically transverse to said conveyor and is actuated by oscillating arms which pivot so as to form a jointed quadrilateral.

4. A device according to claim 1, wherein said ejector is actuated by oscillating arms pivoting so as to form a jointed quadrilateral;

said ejector being able to enter into a housing formed by said drawer, from a side opposite in respect of said outfeed opening.

5. A device according to claim 1, wherein said lift has a pair of blocks located externally in respect of said guides, in an outfeed area of said conveyor, said lift being actuated in a vertical direction by oscillating arms which pivot so as to form a jointed quadrilateral.

6. A device according to claim 1, wherein said magazine includes:

a pair of sides, positioned lengthwise with respect to sidepieces of said conveyor;

pivoting supports, elastically fixed to a base of said magazine, said pivoting supports being designed to pivot while a blister pack is being inserted into said magazine and then to support a stack of blister packs inserted into said magazine.

7. A device according to claim 1, wherein said conveyor has a pair of belts arranged side by side and moved with an intermittent motion between a pair of sidepieces featuring lengthways grooves serving as a guide for edges of said blister pack, said belts having adjustable crosspieces, with said blister packs held during movement between said crosspieces.

8. A device according to claim 1, wherein said conveyor consists of two side-by-side belts, said guides extending along said conveyor while remaining almost into contact with longitudinal external edges of said belts, at a level of upper surfaces of said belts.

9. A device according to claim 8, wherein between said belts, at level of said upper surfaces of said belts, there is a spacer designed to prevent said belts from overlapping.

10. A device according to claim 8, wherein said guides protrude above said belts at level of said upper surfaces.

11. A device according to claim 1, wherein said lift, said pusher, said drawer, and said ejector, are controlled by organs, located upstream of said stack forming station, said organs being designed to check the presence of said blister packs.

* * * * *